United States Patent [19]

Karolyi

[11] Patent Number: 4,998,669

[45] Date of Patent: Mar. 12, 1991

[54] CONTAINER FOLDED FROM A BLANK

[75] Inventor: Oskar Karolyi, Bad Boll, Fed. Rep. of Germany

[73] Assignee: Michael Horauf Maschinenfabrik GmbH & Co. KG, Donzdorf, Fed. Rep. of Germany

[21] Appl. No.: 560,178

[22] Filed: Jul. 31, 1990

[30] Foreign Application Priority Data

Aug. 17, 1989 [DE] Fed. Rep. of Germany ..... 3927187

[51] Int. Cl.[5] ..... B65D 5/24

[52] U.S. Cl. ..... 229/170; 229/169; 229/188

[58] Field of Search ..... 229/125, 35, 169, 170, 229/188

[56] References Cited

U.S. PATENT DOCUMENTS

| | | | |
|---|---|---|---|
| 3,550,835 | 12/1970 | Persson | 229/125.35 |
| 3,606,078 | 9/1971 | Phillips, Jr. | 229/170 |
| 4,114,797 | 9/1978 | Manizza | 229/169 |
| 4,308,985 | 1/1982 | Manizza et al. | 229/125.35 |
| 4,533,079 | 8/1985 | Persson | 229/170 |
| 4,687,130 | 8/1987 | Beller | 229/188 |
| 4,944,451 | 7/1990 | Forbes, Jr. | 229/125.35 |

*Primary Examiner*—Gary E. Elkins

*Attorney, Agent, or Firm*—Burns, Doane, Swecker & Mathis

[57] ABSTRACT

A folded container comprises a rectangular bottom and four folded-out sides. A double walled border flange extends around the periphery of the container parallel to the bottom. The free open edges of the border flange face toward the external surfaces of the sides. The sides are connected by means of folded, triangular corner sections. Two border strips forming portions of the border flange are provided with narrow recesses which mate with correspondingly shaped projections disposed on the edges of some of the corner sections. The projections snap into the recesses upon the folding out of the sides to render the container self-supporting in the erected position for subsequent processing prior to the bonding of the individual surfaces.

8 Claims, 3 Drawing Sheets

CONTAINER FOLDED FROM A BLANK

BACKGROUND OF THE INVENTION

The invention concerns a container folded from a sealable cardboard blank, in particular a food serving tray having a rectangular bottom, four folded sides each joined by the folding over of two essentially triangular corner regions, and a border flange parallel to the bottom of the border flange formed by four border strips joined to the sides by fold lines.

In a known container of this type, disclosed for example in German OS-25 45 410, two opposing border strips defining the border flange are in the form of a single layer, while the two other border strips of the border flange are in the form of three layers. The free outer edges of the border strips face outwardly, i.e,, are exposed to the outside containers of this type are not uniformly stable due to the uneven border flange and cannot be used in all cases. Containers of this type are stable enough to be further transported only after adhesive bonding or sealing.

From U.S. Pat. No. 4,199,097 there is known a folded container, not of this generic type, with arching external walls contiguous with each other. The container has a circumferential two-layer border flange which, however, is not parallel to the bottom. The cut edge is oriented toward the inner reversed edge of the border flange and is not exposed to the outside. In order to make possible the folding of the two-layer border flange in the arched areas, a plurality of conical, indented tabs is provided in the outer edge part of the border flange, which permits folding into a rounded shape. Containers of this type may be made of a thinner and thus less expensive material.

From European Patent 022 139, there is known a folded container with a border flange disposed parallel to the rectangular bottom. Two opposing border strips are equipped in the area of their corners with projections acting in the manner of hooks which, after the folding step grip the corners under the two adjacent border strips of the border flanges. The folded container is provided in this manner with a certain structural rigidity which, even prior to sealing, makes possible the safe transport of the folded container to other processing stations. However, the border flange has only one layer. It is, therefore, not possible to use a relatively thin initial material.

It is an object of the invention to develop a container of the afore-mentioned type at a low cost so that it may be made from a thin initial material, but which is provided with adequate cohesion and rigidity after folding and prior to sealing.

SUMMARY OF THE INVENTION

This object is attained in accordance with the invention in that the border flange has double walls over its circumference and is oriented with its outer free edge against the outer surfaces of the sides so as not to be exposed.

It is possible in this manner to use a very thin cardboard for the container which nevertheless has adequate stability. The free edge of the border flange is located under the surface of the border, so that a smooth container edge is formed.

Preferably, at least two opposing border strips are, in the vicinity of the container corners, provided with small recesses on their outer edges, with correspondingly shaped projections being located on the cut edges of the adjacent corner regions. The projections, which protrude conveniently only by a distance corresponding to about the thickness of the associated edge, are able to snap into the coordinated recesses upon the folding of the side fields, so that adequate cohesion is assured upon folding and prior to the sealing of the container.

In an advantageous embodiment of the invention, the corner regions disposed adjacent to the projection-carrying corner regions are provided with supporting surfaces for underlying the border flange. It is assured in this manner that the border flange is actually parallel to the bottom.

The process for making the container is advantageously carried out by initially double folding the border flange and then sealing it separately. In the sealing process, the areas of the recesses may be exempted, although this is not absolutely necessary. The sides are then folded up and transported to another sealing station, with the container remaining self-supporting after the folding up.

BRIEF DESCRIPTION OF THE DRAWINGS

The objects and advantages of the invention will become apparent from the following detailed description of a preferred embodiment thereof in connection with the accompanying drawings, in which like numerals designate like elements, and in which.

DETAILED DESCRIPTION OF A PREFERRED EMBODIMENT OF THE INVENTION

Figure 1:
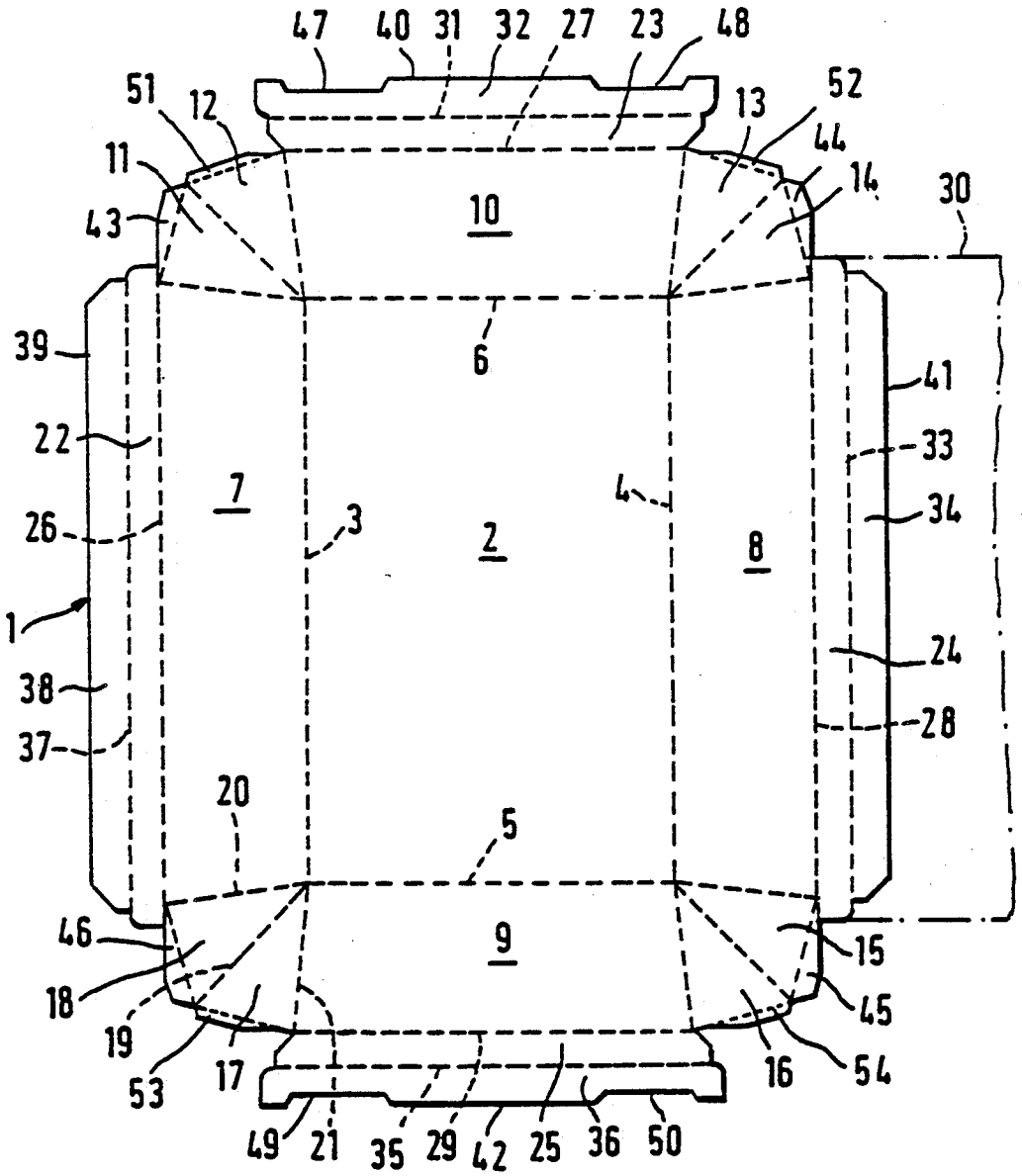
FIG. 1 is a plan view of a flat, one-piece blank for making a container according to the invention, in which the free outer edges of the blank are indicated by solid lines and the fold lines are indicated by broken lines, and the dash-dot lines illustrate an alternative feature according to the invention.
Figure 2:
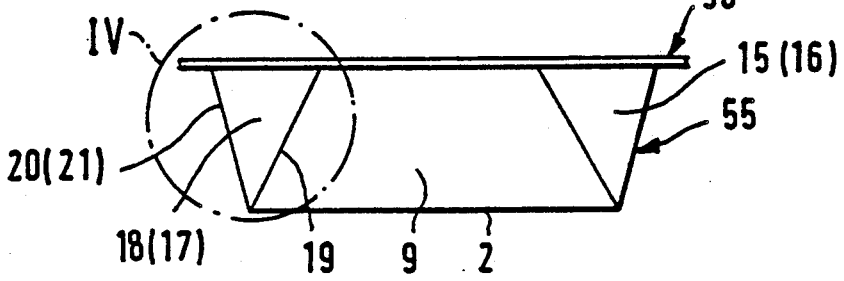
FIG. 2 is a schematic lateral elevational view of a folded-up container according to the invention.
Figure 3:
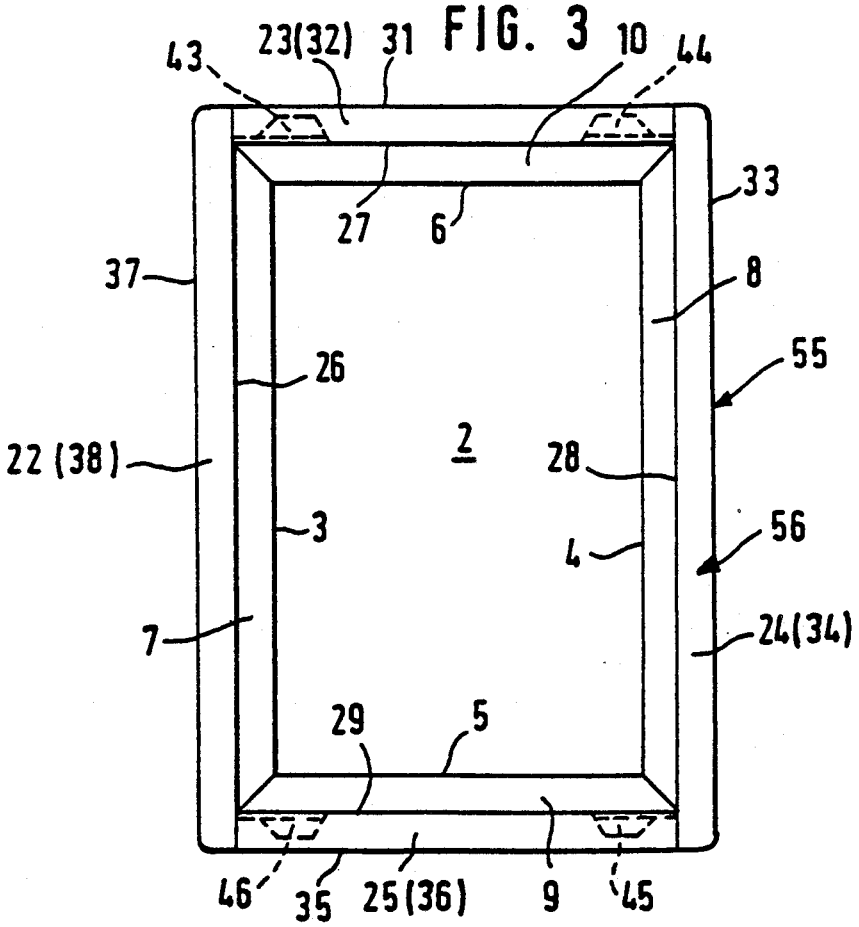
FIG. 3 is a top plan view of the container of FIG. 2.

The container blank 1 of FIG. 1 is provided in its center area with folding lines 3, 4, 5, 6, which border the bottom section 2 of a folded container 55 (see also FIGS. 2 and 3). Side sections 7, 8, 9, 10 border on the bottom 2 and are delimited by the folding lines 3, 4, 5, 6 relative to the bottom 2. Parallel to the folding lines 3 to 6, the sides 7 to 10 are bordered by other folding lines 26, 27, 28, 29. At these delimiting folding lines 26 to 29 a border flange 56 begins after the folding of the container 55 (see also FIGS. 2 and 3).

Between the sides 7 and 10, triangular corner sections or regions 11 and 12 are located, which connect the side fields 7 and 10 after the container 55 has been folded. The corner regions 11 and 12 are configured so that the sides 7 and 10 are slightly trapezoidal in shape, as are the other sides 8 and 9, with the folding lines 3 to 6 adjacent to the bottom 2 being the shorter edges of the trapezoids. Correspondingly, two triangular corner regions 13, 14, 15, 16, 17, and 18 are provided at each of the other corners.

As exemplified by the two corner regions 17 and 18, each of the associated pairs of regions 11 to 18 is separated by a folding line 19. The corner regions 11 to 18 are separated from associated ones of the sides 7 to 10 by folding lines 20 and 21, as exemplified by the corner region 17 and the side 9 on the one hand, and the corner region 18 and the side 7, on the other hand.

The sides 7 to 10 are bordered by inner border strips 22, 23, 24 and 25, which are delimited by first folding edges 26, 27, 28, 29 relative to the sides 7 to 10. Parallel to the first folding edges 26 to 29, second folding edges 31, 33, 35 and 37 are provided, whereby outer border strips 32, 34, 36 and 38 are bordering on the afore-mentioned inner border strips 22, 23, 24, 25.

Alternatively, in place of one pair of the border strips 24 and 34, a cover 30 indicated by a dash-and-dot line, may be provided which is foldable along the line 28.

The associated inner and outer border strips are folded onto each other around the afore-mentioned folding lines 31, 33, 35, 37, so that on the finished container 55 a circumferential, double walled border flange 56 is obtained. In this manner, the border strips 23 and 32, the border strips 24 and 34, the border strips 25 and 36 and the border strips 22 and 38 are mutually folded. The folding process is carried out so that the free outer edges 39, 40, 41, 42 after the folding of the container 55 are located under the upper edge of the border and are directed toward the outer surfaces of the folded sides 7 to 10 (see also edge 39 in FIG. 4).

Provided on the corner regions 11, 14, 15 and 18 which border the larger sides 7 and 8 are small surfaces 43, 44, 45, 46 which upon the erection of the container are folded to the outside and against the outer surfaces of the smaller sides 9, 10 in the area of the outer edges. The small surfaces 43 to 46 serve as support surfaces for the border flange 56 after the folding of the container 55. The support surfaces 43 to 46 also assist in the subsequent sealing process.

The outer border strips 32 and 36 associated with the smaller sides 9 and 10 are provided with recesses 47, 48, 49, 50 in the area of their adjacent corner regions 12, 13 and 16 and 17, the recesses being formed in the outer edges 40 and 42. The recesses 47 to 50 are very narrow and preferably rectangular or trapezoidal. The depth of the recesses is only slightly greater than the wall thickness of the blank 1. The recesses 47 to 50 are coordinated with projections 51, 52, 53, 54 of the adjacent corner regions 12, 13, 16, 17, the dimensions of which are approximately correlated with those of the recesses and which protrude from the associated edge only at a distance approximately corresponding to the thickness of the material. During the folding of the container 55, the projections 51 to 54 snap into their associated recesses 47 to 50, as described later in connection with FIG. 4.

FIGS. 2 and 3 show the folded container 55. FIG. 2 illustrates the schematically indicated double walled border flanges 56, together with two corner regions 15 and 18, which overlie the corner regions 16 and 17. In the area of the corner region 18, the folding edge 20 may be seen, which covers a not-visible folded edge 21 located therebehind. The folding line 19 is further seen, which separates the visible corner region 18 from the not-visible corner region 17 disposed under it.

FIG. 3 depicts the manner in which the supporting surfaces 43, 44, 45, 46 are contacting the border flange 56 from below. The border flange 56 is formed by eight border strips 22, 23, 24, 25, and 32, 34, 36, 38; they are superimposed, thereby rendering the border flange 56 double walled. The border strips 32, 34, 36, 38 are not visible from above, as indicated by the reference symbols set in parentheses in FIG. 3.

Figure 4:
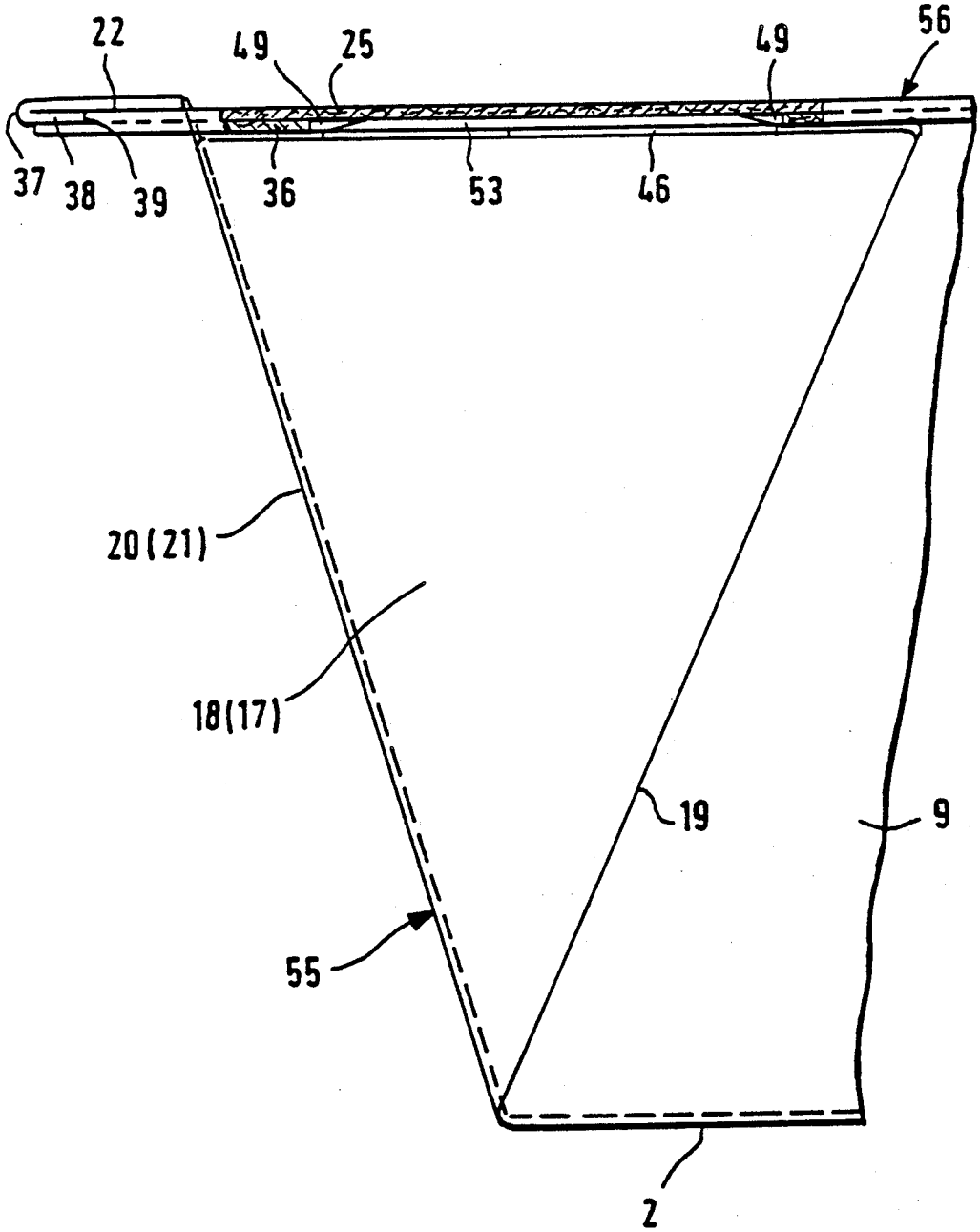
FIG. 4 is a greatly enlarged view of a detail IV identified in FIG. 2 by a dash-and-dot circle.

In FIG. 4 a segment from FIG. 2 is shown significantly enlarged and partially sectioned, as indicated in FIG. 2 by the dash-and-dot circle at IV.

It is seen in FIG. 4, for example, the manner in which the border strips 22 and 38 are folded around their folding line 37 and located relatively to the border strips 25 and 36 associated with the side 9 and also placed upon each other. Outside the area of the border strips 25, 26 the border strips 22, 38 are located directly upon each other.

FIG. 4 also shows the projection 53 provided on the not-visible corner region 17 in the area of which, after folding, the border strip 36 contains the recess 49. Upon folding, the projection 53 snaps into the recess 49 and provides the folded container 55 with adequate cohesion even prior to sealing. In a corresponding manner, the other projections 51, 52 and 54 also lock into the appropriate recesses 47, 48 and 50.

The container 55 according to the invention makes it possible to use a very thin walled blank 1, which however, due to the double wall of the border flange 56 is adequately stable and which preferably makes it possible to provide sufficient shape retention for the further processing of the cover even prior to its final sealing.

As further seen in FIG. 4, the edges 39 to 42 (only the edge 39 being visible in FIG. 4) are located in a manner such that they are not accessible from inside the container 55. The edges 39 to 42 of the container 55 are thus adequately protected if it is taken into consideration that the blank 1 is provided with a liquid tight coating at least on the surface thereof which forms the internal surface of the container 55.

Although the present invention has been described in connection with a preferred embodiment thereof, it will be appreciated by those skilled in the art that additions, modifications, substitutions, and deletions not specifically described may be made without departing from the spirit and scope of the invention as defined in the appended claims.

What is claimed is:

1. A container erected from a sealable cardboard blank, said container comprising a rectangular bottom section and four folded-out side sections, adjacent ones of said side sections being interconnected by a pair of generally triangular corner sections wherein one of said corner sections is connected to one of said adjacent side sections and the other of said corner sections is connected to the other of said adjacent side sections, a border flange extending around a perimeter of said container parallel to said bottom section, said border flange comprising four border strip means joined to respective ones of said side sections, each of said border strip means being of double wall construction and having an outer free edge oriented to face toward an outer surface of a respective side section.

2. A container according to claim 1, wherein said corner sections of each said pair of corner sections are folded together along a fold line and are folded against said outer surface of one of said adjacent side surfaces.

3. A container according to claim 2, wherein said side sections include a pair of opposing long side sections and a pair of opposing shorter side sections, all of said pairs of corner sections being folded against said shorter side sections.

4. A container according to claim 1, wherein at least two of said border strip means contain recesses formed in said outer free edges thereof and situated adjacent respective corners of the container, a corner section of each said pair of corner sections carrying a projection mating with a respective one of said recesses, said projection extending from a free outer edge of said corner section.

5. A container according to claim 4, wherein each of said projections projects from a respective free outer edge by a distance corresponding substantially to a thickness of the blank.

6. A container according to claim 4, wherein said recesses and projections are of rectangular shape.

7. A container according to claim 6, wherein said shape is generally trapezoidal.

8. A container according to claim 4, wherein one corner section of each pair of corner sections carries a said projection, the other corner section of each pair of corner sections carrying a support surface, said support surfaces being arranged to underlie and support respective portions of said border flange.

* * * * *